US012428934B2

(12) United States Patent
Shaw

(10) Patent No.: US 12,428,934 B2
(45) Date of Patent: Sep. 30, 2025

(54) SELECTIVELY INJECTABLE CHEMICAL ADDITIVE

(71) Applicant: Silverwell Technology Ltd, Histon (GB)

(72) Inventor: Joel David Shaw, Houston, TX (US)

(73) Assignee: Silverwell Technology Limited, Cambridge (GB)

( * ) Notice: Subject to any disclaimer, the term of this patent is extended or adjusted under 35 U.S.C. 154(b) by 338 days.

(21) Appl. No.: 17/987,613

(22) Filed: Nov. 15, 2022

(65) Prior Publication Data

US 2023/0083821 A1 Mar. 16, 2023

Related U.S. Application Data

(63) Continuation-in-part of application No. 16/861,167, filed on Apr. 28, 2020, now Pat. No. 11,519,248.

(60) Provisional application No. 63/395,250, filed on Aug. 4, 2022.

(51) Int. Cl.

| | |
|---|---|
| ***E21B 41/02*** | (2006.01) |
| ***E21B 43/12*** | (2006.01) |
| ***E21B 47/11*** | (2012.01) |

(52) U.S. Cl.

CPC ..... *E21B 41/02* (2013.01); *E21B 43/122* (2013.01); *E21B 47/11* (2020.05)

(58) Field of Classification Search

CPC ..... E21B 41/02; E21B 43/122; E21B 47/11

See application file for complete search history.

(56) References Cited

U.S. PATENT DOCUMENTS

| | | | | |
|---|---|---|---|---|
| 4,347,899 | A * | 9/1982 | Weeter | E21B 43/123 166/371 |
| 4,502,843 | A | 3/1985 | Martin | |
| 4,972,704 | A | 11/1990 | Wellington et al. | |
| 5,182,939 | A | 2/1993 | Chien et al. | |
| 5,253,713 | A | 10/1993 | Gregg et al. | |

(Continued)

FOREIGN PATENT DOCUMENTS

| | | | |
|---|---|---|---|
| CN | 105781494 | A | 7/2016 |
| EP | 3553274 | A1 | 10/2019 |

(Continued)

OTHER PUBLICATIONS

International Search Report and Written Opinion for PCT Application No. PCT/GB2023/052024 dated Oct. 11, 2023.

(Continued)

*Primary Examiner* — Robert E Fuller

(74) *Attorney, Agent, or Firm* — Bracewell LLP; Keith R. Derrington

(57) ABSTRACT

An apparatus for producing fluid from a wellbore includes production tubing in the wellbore, an annulus around the tubing, and a chemical injection system for injecting chemical additive into the production tubing from the annulus. The chemical additive system includes an injection module with a valve that is selectively opened and closed by operating an actuator. When the valve is opened, the chemical additive is injected into the tubing in response to a pressure differential between the annulus and tubing. The injection module is surface-controlled and downhole conditions are monitored, so that a flow of chemical additive injection is initiated, adjusted, or suspended in real time.

19 Claims, 10 Drawing Sheets

(56) References Cited

U.S. PATENT DOCUMENTS

| | | | | |
|---|---|---|---|---|
| 5,881,807 | A | 3/1999 | Boe et al. | |
| 6,131,451 | A | 10/2000 | Izbicki et al. | |
| 6,147,034 | A | 11/2000 | Jones et al. | |
| 6,148,923 | A | 11/2000 | Casey | |
| 6,176,309 | B1 | 1/2001 | Bender | |
| 6,645,769 | B2 | 11/2003 | Tayebi et al. | |
| 6,840,316 | B2 | 1/2005 | Stegemeier et al. | |
| 7,870,899 | B2 | 1/2011 | Wilson | |
| 7,954,545 | B2 | 6/2011 | Hearn et al. | |
| 8,150,637 | B2 | 4/2012 | Peacock et al. | |
| 8,925,638 | B2 | 1/2015 | Wygnanski | |
| 9,297,247 | B2 | 3/2016 | Lea, Jr. | |
| 9,695,680 | B2 | 7/2017 | Bergman | |
| 10,030,508 | B2 | 7/2018 | Romer et al. | |
| 10,883,349 | B2 * | 1/2021 | Campbell | E21B 43/129 |
| 11,401,788 | B2 | 8/2022 | Shaw | |
| 2003/0164240 | A1 * | 9/2003 | Vinegar | E21B 41/0085 137/155 |
| 2006/0011345 | A1 * | 1/2006 | Delaloye | E21B 37/06 166/310 |
| 2006/0225888 | A1 | 10/2006 | Reitz | |
| 2011/0155390 | A1 * | 6/2011 | Lannom | E21B 43/121 166/107 |
| 2016/0076926 | A1 * | 3/2016 | McCann | G01F 1/60 73/861.04 |
| 2017/0183955 | A1 | 6/2017 | Peacock et al. | |
| 2018/0030820 | A1 * | 2/2018 | Lacy | E21B 43/16 |
| 2018/0347316 | A1 * | 12/2018 | Peng | C09K 8/532 |
| 2019/0203587 | A1 | 7/2019 | Kulyakhtin et al. | |
| 2019/0316451 | A1 * | 10/2019 | Al-Gouhi | E21B 47/008 |
| 2021/0246770 | A1 | 8/2021 | Shaw | |
| 2021/0332695 | A1 | 10/2021 | Shaw | |

FOREIGN PATENT DOCUMENTS

| | | | |
|---|---|---|---|
| WO | 2019235936 | A1 | 12/2019 |
| WO | 2021152332 | A1 | 8/2021 |

OTHER PUBLICATIONS

International Search Report and Written Opinion of PCT Application No. PCT/GB2021/051018 dated Jul. 29, 2021: pp. 1-15.
PCT ISRWO mailed Apr. 30, 2021, in the prosecution of application PCT/GB2021/050220, 18 pages.

* cited by examiner

SELECTIVELY INJECTABLE CHEMICAL ADDITIVE

CROSS REFERENCE TO RELATED APPLICATIONS

This application claims priority to and the benefit of Shaw, U.S. Provisional Application Ser. No. 63/395,250 ("Shaw '250") filed Aug. 4, 2022 and is a continuation in part of and claims priority to and the benefit of Shaw, U.S. patent application Ser. No. 16/861,167 ("Shaw '167"), filed Jan. 29, 2021. The full disclosures of Shaw '250, Shaw '167, and Shaw, U.S. patent application Ser. No. 17/162,743 are incorporated by reference herein in their entireties and for all purposes.

BACKGROUND OF THE INVENTION

1. Field of Invention

The present disclosure relates to controlling from surface an injection of chemical additives in a well.

2. Description of Prior Art

Hydrocarbon producing wells are drilled into subterranean formations having hydrocarbons trapped within, these wells generally include production tubing for conveying produced fluids from the formation to surface. The produced fluids typically include one or more of liquid hydrocarbons, gas hydrocarbons, and water. Many oil and gas wells have production that can be aided with the addition of chemicals. Typical chemicals include foaming agents, corrosion inhibitors, viscosity reducers, and chemicals for generally improving production.

Often these chemicals are added into the wells through a small diameter capillary tube that extends from the surface down to the injection point. When designing a chemical injection system, it is advisable that chemical level never drops below the surface into the capillary tube so that a void or vacuum to liquid interface does not form in the capillary tube. If there is for any amount of time, many chemicals will evaporate and leave particulates. This in turn clogs the capillary tube and the system will no longer function. Valves on a capillary tube exit are not fully effective as check valves cannot maintain a fluid column in the capillary tube when annulus pressure drops below hydrostatic pressure in the capillary tube, while relief valves increase injection pump head requirements and can leak over time. Maintaining a chemical level in the capillary tube is also important so that flowrates of chemical additive can be accurately monitored. Because chemical additives are usually costly, amounts of chemical additive injected is generally low; and if not accurately monitored well performance can be reduced.

SUMMARY OF THE INVENTION

Disclosed herein is an example of a method and apparatus for producing fluid from a wellbore, where the apparatus includes production tubing in the wellbore, an annulus around the tubing, and a chemical injection system for injecting chemical additive into the production tubing from the annulus. The chemical additive system includes an injection module with a valve that is selectively opened and closed by operating an actuator. When the valve is opened, the chemical additive is injected into the tubing in response to a pressure differential between the annulus and tubing. The injection module is surface-controlled and downhole conditions are monitored, so that a flow of chemical additive injection is initiated, adjusted, or suspended in real time.

BRIEF DESCRIPTION OF DRAWINGS

Some of the features and benefits of the present invention having been stated, others will become apparent as the description proceeds when taken in conjunction with the accompanying drawings, in which.

Figure 1:
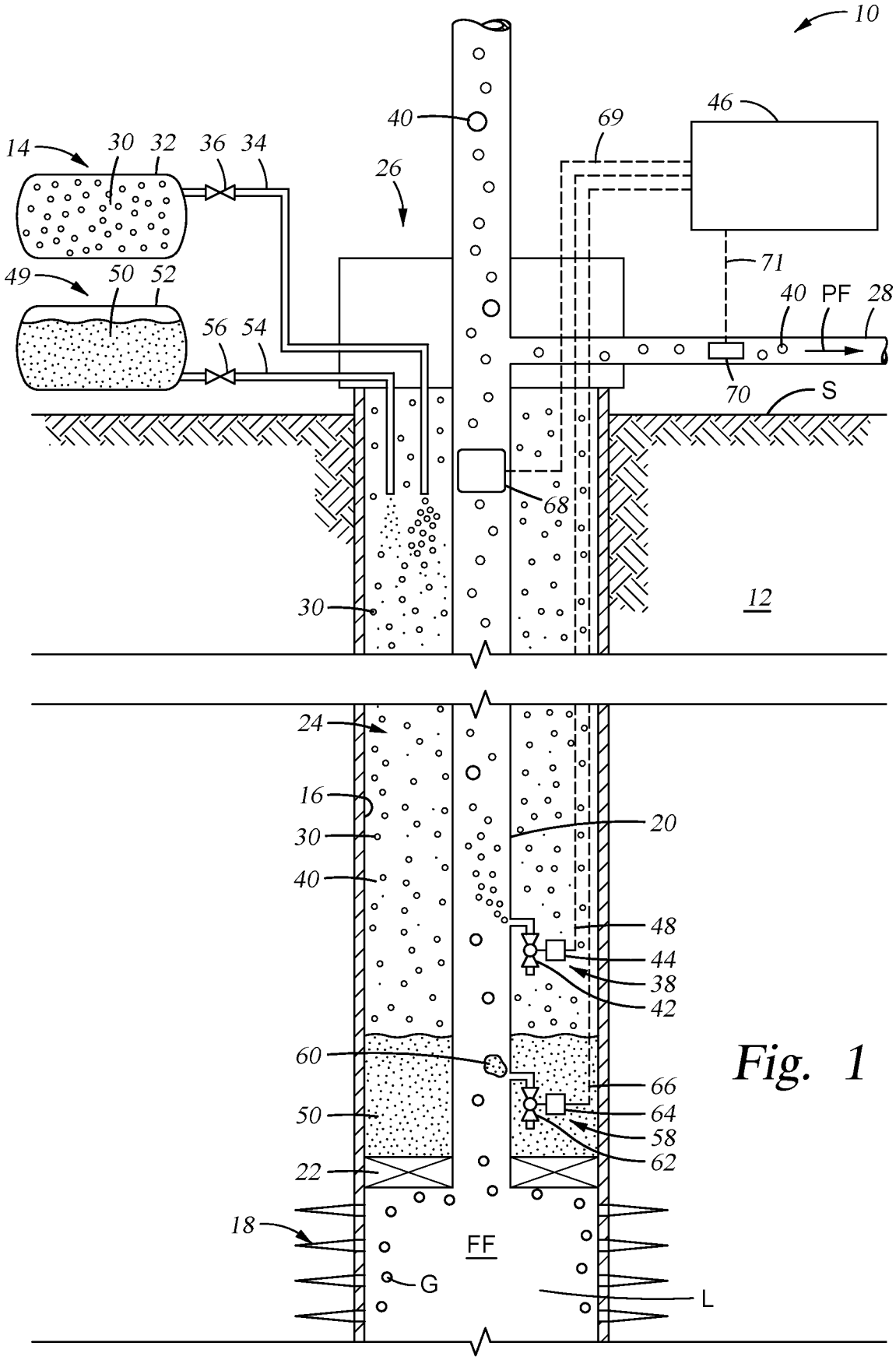
FIG. 1 is a side sectional view of an example of injecting a tracer liquid into a well assisted by lift gas injection.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

An example of a well system 10 is shown in a side partial sectional view in FIG. 1, and where the well system 10 is employed for extracting hydrocarbons from within a subterranean formation 12. An example of a lift gas system 14 is shown included with the well system 10 and for assisting with the lift of liquids collected within a wellbore 16 that penetrates formation 12. Perforations 18 are shown that provide a pathway for the hydrocarbons and other fluids to enter into the lower end of wellbore 16. For the purposes of discussion herein, the hydrocarbons and other fluids in the formation 12 are referred to herein as formation fluid FF. As depicted inside wellbore 16 formation fluid FF is made up of liquid L with amounts of gas G dispersed within the liquid L. A string of production tubing 20 is shown inserted within wellbore 16, inside of which the formation fluid FF make its way uphole. A packer 22 is set at lower end of production tubing 20 and blocks the flow of formation fluid FF into an annulus 24 between the production string 20 and sidewalls of wellbore 16. A wellhead assembly 26 is set at an opening of wellbore 16 and on surface S. In this example, wellhead assembly 26 provides pressure control for the well 16, and also is used for distributing produced fluid PF that has exited well 16. A production line 28 is shown having an end attached to wellhead assembly 26, and which is in communication with the production tubing 20. In the example of FIG. 1, within the wellhead assembly 26 produced fluid PF flowing in the production tubing 26 is redirected into the production line 28; which carries the produced fluid PF offsite.

The lift gas system 14 of FIG. 1 injects a lift gas 30 downhole, the lift gas 30 is provided by a lift gas source 32 schematically shown as a container on surface S. Other embodiments of the lift gas source 32 are envisioned and include surrounding wells, pipelines, compressors, tanks, and the like. A lift gas line 34 is included with the example lift gas system 14, and shown having an inlet end attached to the lift gas source 32, and a distal discharge end inserted into the well in annulus 24. In a non-limiting example, lift gas 30 is introduced into annulus 24 by selectively opening and closing a lift gas valve 36 illustrated disposed within lift gas line 34. Depicted in the example of FIG. 1 is an amount of lift gas 32 having been introduced into the well 16 and that substantially occupies the space within annulus 24. A lift gas injection module 38 is shown mounted onto an outer sidewall of production tubing 20 that selectively injects amounts of the lift gas 30 into the production tubing 20 to produce bubbles 40 of lift gas 30 inside the production tubing 20 that are combined with the formation fluid FF to form the produced fluid PF. The produced fluid PF with its added bubbles 40 is a two-phase flow stream with a density less than the formation fluid FF, and which promotes the flow of the produced fluid PF upwards within the well 16 and lifting of the formation fluid FF. In an example, within the two-phase flow stream of produced fluid PF and lift gas 30 upwards within the production tubing 20, the lift gas 30 velocity exceeds formation fluid FF velocity; a ratio of those velocities is referred to as a slip factor or slip ratio. In the embodiment illustrated, the lift gas injection module 38 includes an injection valve 42 that is selectively opened to inject lift gas 30 into production tubing 20. Further included in the example is an actuator 44 shown coupled with injection valve 42 for providing a motive force for actuating valve 42. In an alternative, commands initiating operation of actuator 44 are provided from a controller 46 shown outside of wellbore 16 and that are transmitted by a communication line 48.

Still referring to FIG. 1, an example of a tracer liquid injection system 49 is included with the well system 10 and which is used for selectively providing tracer liquid 50 into the stream of produced fluid PF flowing upwards within the production tubing 20. In this example, tracer liquid 50 is provided by a tracer liquid source 52 which is schematically illustrated as a vessel, alternate embodiments of the tracer liquid source 52 include pipelines, tanks, trucks, and the like. A tracer liquid supply line 54 extends from tracer liquid source 52 and has a discharge end set within annulus 24. Shown integral with tracer liquid supply line 54 is a tracer liquid supply valve 56 that is selectively opened and closed to allow for the discharge of the tracer liquid from the tracer liquid supply source 52 and into annulus 24. In the example shown the tracer liquid 50 has a density higher than the lift gas 30 and when added into the annulus 24 the tracer liquid 50 drops through the lift gas 30 and collects in a lower end of annulus 24, and is shown supported on packer 22. Also included with the example tracer liquid injection system 49 is a tracer liquid injection module 58 shown in the annulus 24 and at a depth between packer 22 and lift gas injection module 38. In an example, amounts of tracer liquid 50 are injected into the production tubing 20 and through tracer liquid injection module 58. In one embodiment, tracer liquid 50 is a liquid with viscous properties so that when amounts are introduced into another liquid the amount of tracer liquid 50 injected forms a tracer liquid assemblage 60, and remains cohesive as it flows upward in the production tubing 20 with the stream of produced fluid PF. In a non-limiting example a designated amount of tracer liquid 50 is added to annulus 24 so that when collected in the annulus 24 and supported on an upper surface of packer 22, an upper level of the tracer liquid 50 is above tracer liquid injection module 58 so that tracer liquid injection module 58 is fully submerged within the tracer liquid 50. In this example operation of tracer liquid injection module 58 is similar to that of the lift gas injection module 38, and includes a tracer liquid injection valve 62 shown coupled with a tracer liquid actuator 64 for opening and closing valve 62. In an alternative, signals for opening and closing the valve 62 are sent to actuator 64 via communication line 66. Similar to communication line 48, communication line 66 connects to controller 46 on surface. In an alternative, lines 48 and 66 connect to one another, and a single line extends to controller 46 above where they connect. Embodiments of the tracer fluid 50 include liquids with characteristics (such as salinity) or components making them detectable by sensors when in a flow of fluid. A tracer liquid sensor 68 is shown coupled with production tubing 20 and at a location distal from where the assemblage 60 is introduced into the production tubing 20. Alternate embodiments have the sensor 68 proximate to the module 58 or within wellhead assembly 26. In this example, sensor 68 is in communication with controller 46 via a communication link 69, an embodiment of which is like the other communication lines disclosed herein is hard-wired, fiber optic, and/or wireless. Further optionally, an additional tracer liquid sensor 70 is shown downstream and within the production line 28 and that is in communication with the controller via communication link 71.

Figure 2:
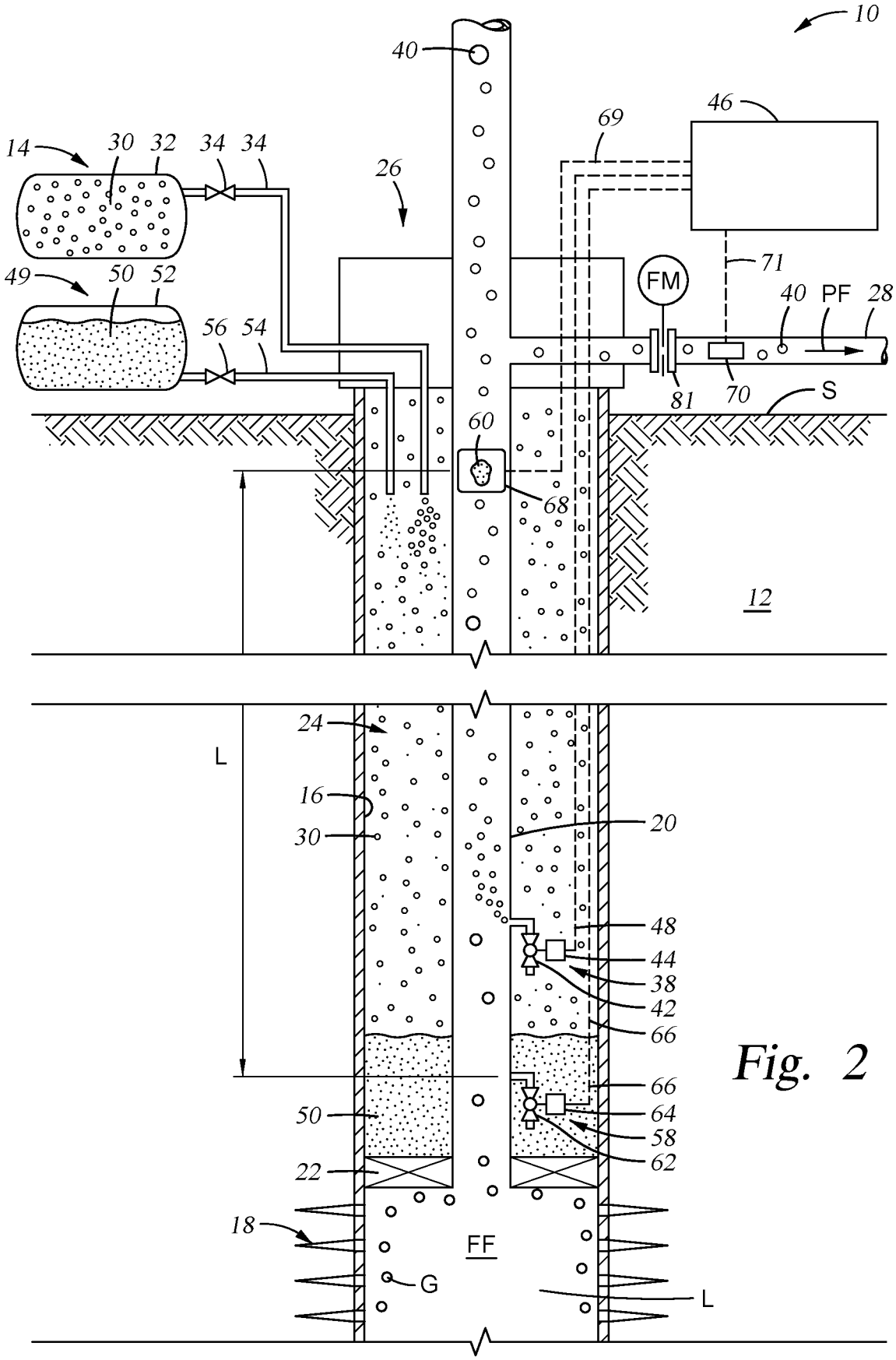
FIG. 2 is a side sectional view of the well of FIG. 1 at a period of time after the tracer liquid was injected.

Referring now to FIG. 2, tracer assemblage 60 is shown within production tubing 20 and adjacent the sensor 68. Further shown in the example of FIG. 2, is a wing valve (not shown) 89 in the production line 28, and a flow meter 81 also within the production line 28. In an embodiment, wing valve 89 is throttled to control a flow rate in production line 28 and/or pressure in production string 20; and alternatively, flow meter 81 is monitored for estimating a flow rate of the total flow of produced fluid PF flowing through the production line 28 and which is selectively monitored for obtaining a flow rate of produced fluid PF flowing through production tubing 20. In a non-limiting example of operation, a time is recorded when the tracer liquid assemblage 60 is introduced into the production string 20, and a time is recorded when the assemblage 60 is sensed by sensor 68, which is referred to herein as a travel time for the liquid assemblage 60 in the production tubing 20 between the tracer liquid injection module 58 and sensor 68. In an alternative, the time when the assemblage 60 is introduced into the production string 20 is set to when the injection module 58 is actuated to open valve 62. Based on the travel time and length L of travel distance in the production tubing 20 between the tracer liquid injection model 58 and the sensor 68, a velocity is estimated of the liquid assemblage 60 when traveling along the length L. In an example, a density of the tracer liquid assemblage 60 is approximate to that of the liquid L flowing in the produced fluid PF; the example assumes that the tracer liquid assemblage 60 travels at substantially the same rate as the liquid L within the produced fluid PF. As noted above, an estimate of total flow of produced fluid PF flowing uphole is obtainable by monitoring output from flow meter 81. Further in this example, a velocity of the bubbles 40 of the lift gas 30 flowing within production tubing 20 is estimated by monitoring a time when lift gas 30 is injected into production tubing 20 (alternatively concurrent with opening of invention valve 42), and when a corresponding increase in the flow rate of produced fluid PF is sensed by flow meter 81. Based upon these respective estimated velocities of the bubbles 40 of lift gas 30 and liquid L, a slip factor is established and deemed to represent a slip factor between liquid L and gas within the produced fluid PF.

Figure 3:
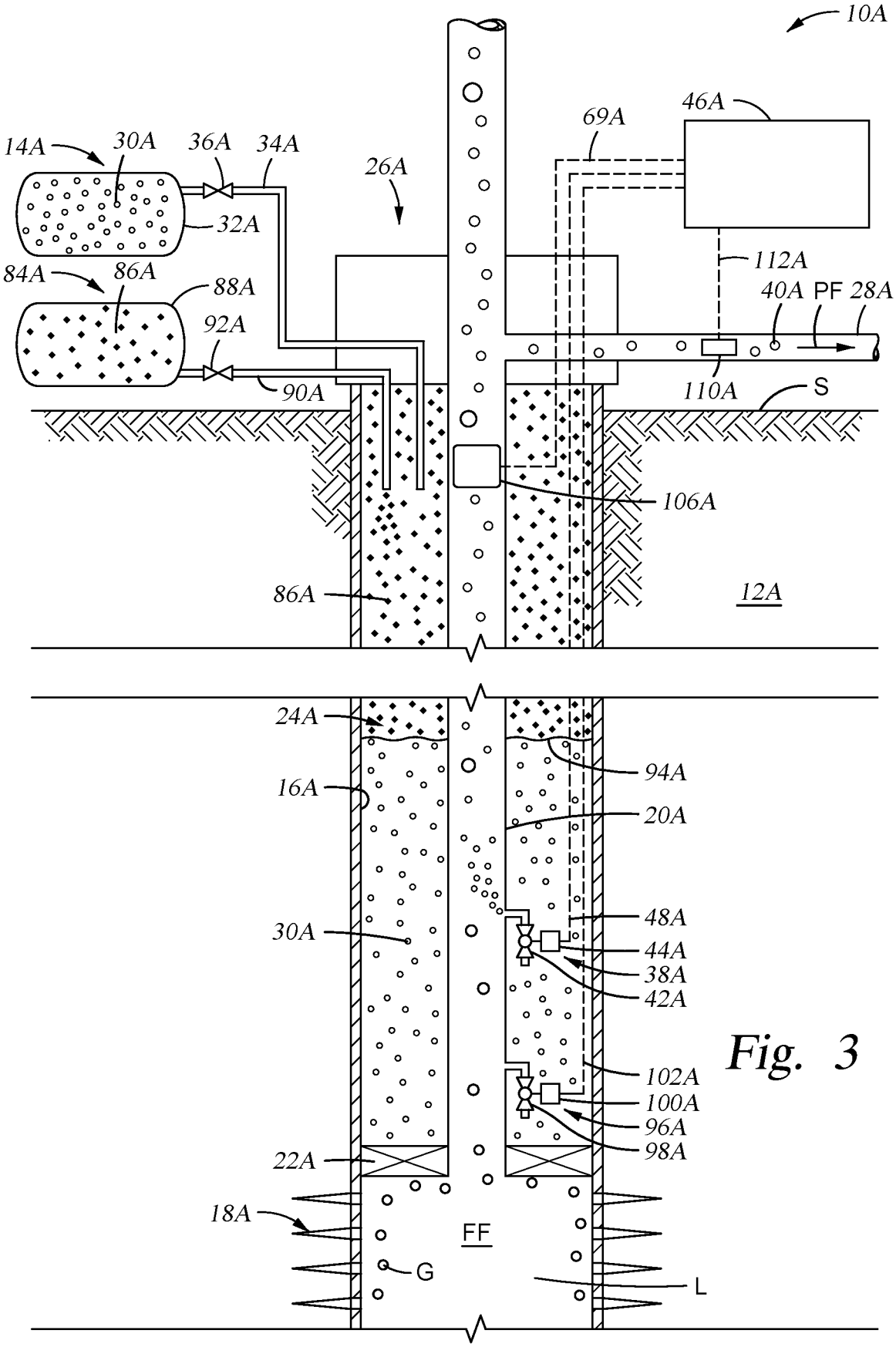
FIG. 3 is a side sectional view of an example of introducing a tracer gas into an annulus of a well that is assisted by lift gas injection.

An alternate example of a well system 10A is shown in side sectional view in FIG. 3 and which like the well system 10 of FIG. 1 includes a lift gas system 14A with lift gas 30 from a lift gas source 30A introduced into the well 16A through line 34A. Valve 36A provides selective regulation of lift gas 30A into the well 16A. In the example of FIG. 3, a tracer gas injection system 84 is included and which selectively introduces an amount of tracer gas 86A into the production tubing 20A. Included with the tracer gas injection system is a tracer gas source 88A and a tracer gas line 90A having one end connected to source 88A and a discharge end disposed in the annulus 24A. Valve 92A regulates the introduction of the tracer gas 86A into annulus 24A. Here, the tracer gas 86A being introduced into annulus 24A is shown urging the lift gas 30A downward within annulus 24A; an interface 94A is defined that represents a border between the tracer gas 86A and lift gas 30A, and which is shown extending perpendicularly within annulus 24A. During this time, the bubbles 40A of injection gas 30A are being introduced into the production tubing 20A and assisting lifting of fluids from within well 16A. Alternatively tracer gas 86A is added into the annulus 24A with the lift gas 30A and flows in the annulus 24A and inside the production tubing 20A combined with the lift gas 30A. In an embodiment tracer gas source 88A is a bottle (not shown) on surface, and an example amount of tracer gas 86A contained in bottle is around 20 pounds. In an example, a time of when tracer gas 86A is introduced into the tubing 20A is calculated based on the flow rates of fluid (i.e. lift gas 30A, tracer gas 86A, a combination of lift gas 30A and tracer gas 86A) flowing downward inside the annulus 24A from surface. It is within the capabilities of one skilled to estimate the travel time of the fluid flowing downward in the annulus 24A.

Figure 4:
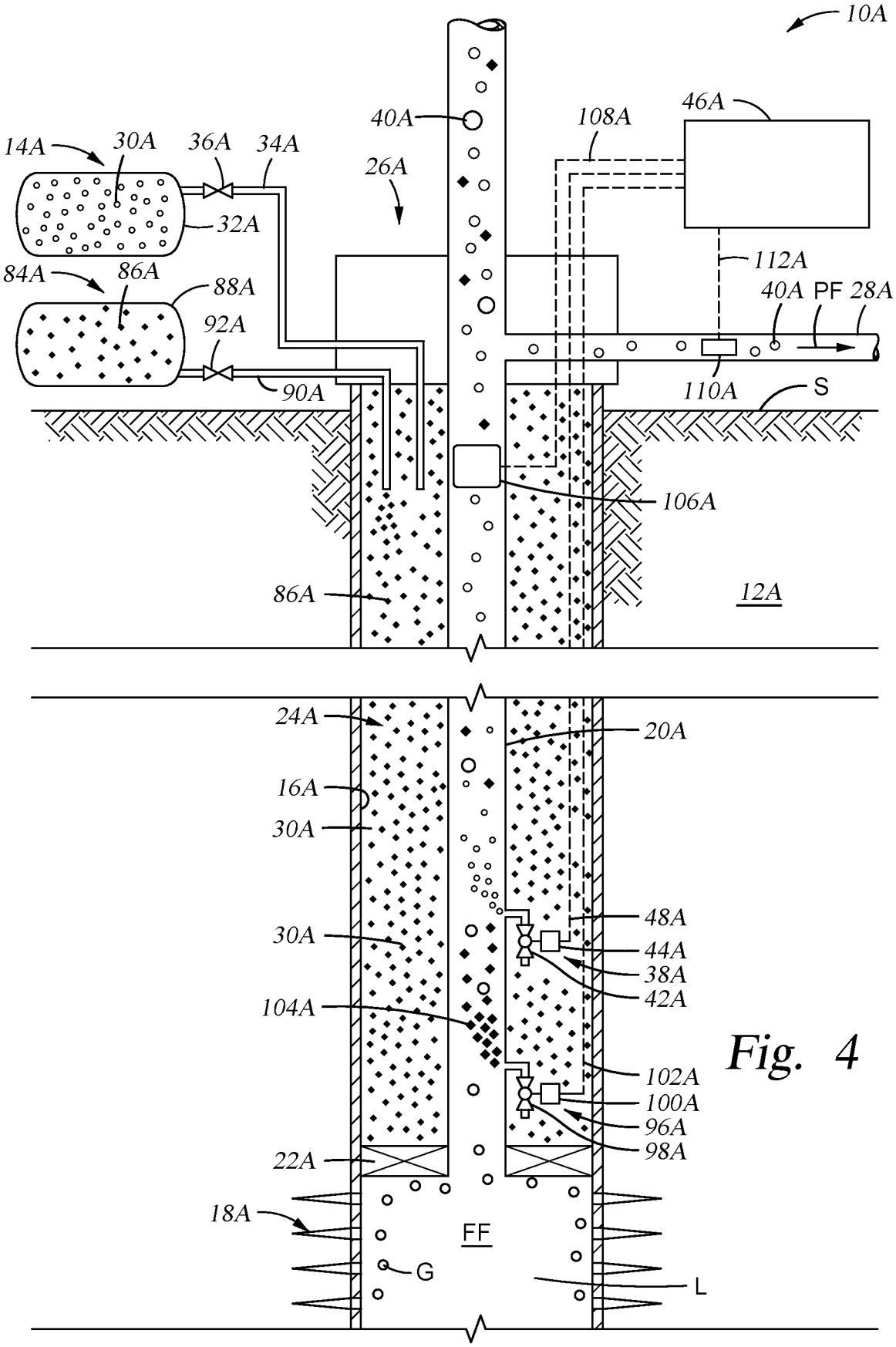
FIG. 4 is a side sectional view of an example of injecting the tracer gas from the annulus into production tubing in the well of FIG. 3.
Figure 5:
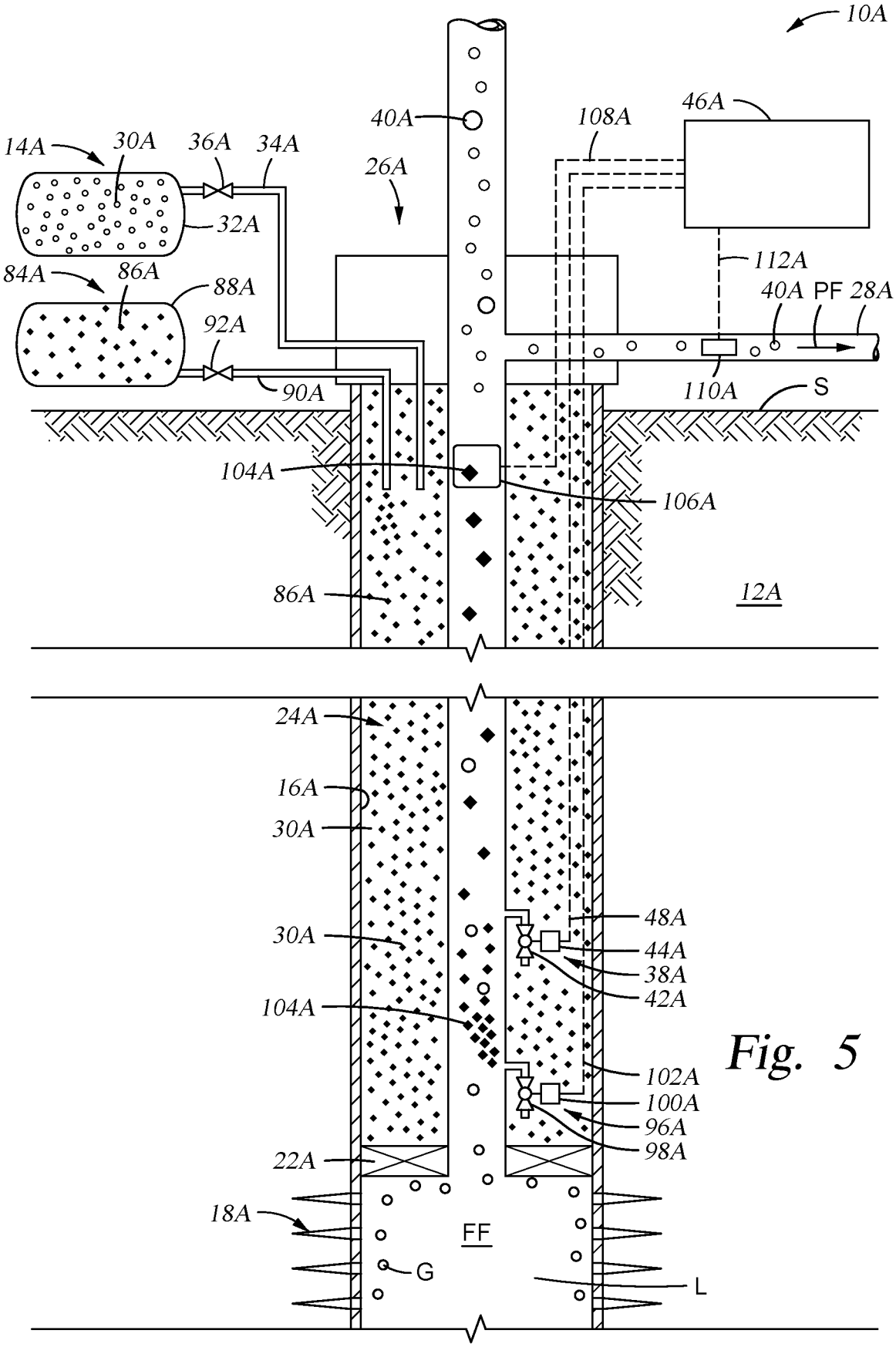
FIG. 5 is a side sectional view of the well of FIGS. 3 and 4 at a period of time after the tracer gas was injected into the production tubing.

Referring now to FIG. 4, shown in side sectional view is that the tracer gas 86A is continued to be introduced into the annulus 24A and has purged substantially all of the lift gas 30A from within annulus 24A, through the injection module 38A, and to inside of production tubing 20A. Referring back to FIG. 3, included with the tracer gas injection system is a tracer gas injection module 96A which includes a valve 98A and operable with an attached actuator 100A which receives command signals from controller 46A via communication line 102A. Similar to the injection module 38A, selective opening and closing of valve 98A provides communication between annulus 24A and inside of production tubing 20A. Referring back to FIG. 4, a command from controller 46A selectively opens the valve 98A of module 96A so that a bubble 104A of tracer gas 86A is introduced into the production tubing 20A. As shown in FIG. 5 bubble 104A moves upward in the production string 20A with the flow stream of produced fluid PF, and after a period of time the bubble 104A of tracer gas is adjacent a sensor 106A that is responsive to a characteristic of the tracer gas 86A. In one example, the tracer gas 86A includes an amount of carbon dioxide, and the presence of which is that detectable by sensor 106A. Alternatively, substances for use in tracer gas 86A and tracer liquid 50 are obtainable from Tracerco, 5th Floor, 25 Farringdon Street, London EC4A 4AB and from Resmetrics, Houston, Texas (832) 592 1900. A communication link 108A provides communication between sensor 106A and controller 46A. A second flow tracer gas sensor 110A is shown downstream of sensor 106A and within production line 28A, which is also responsive to presence of the tracer gas 86A. In one example, results from monitoring travel of bubbles 104A of tracer gas 86A within production tubing 20A provide information about the slip factor of the produced fluid PF flowing within production tubing 20A. Similar to the example of FIG. 2, in an embodiment travel time of tracer gas 86A between injection module 96A and sensor 106A is monitored, and along with a distance Li between injection module 96A and sensor 106A, and estimate of velocity of tracer gas 86A in production tubing 20A is estimated for estimating slip factor.

Figure 6:
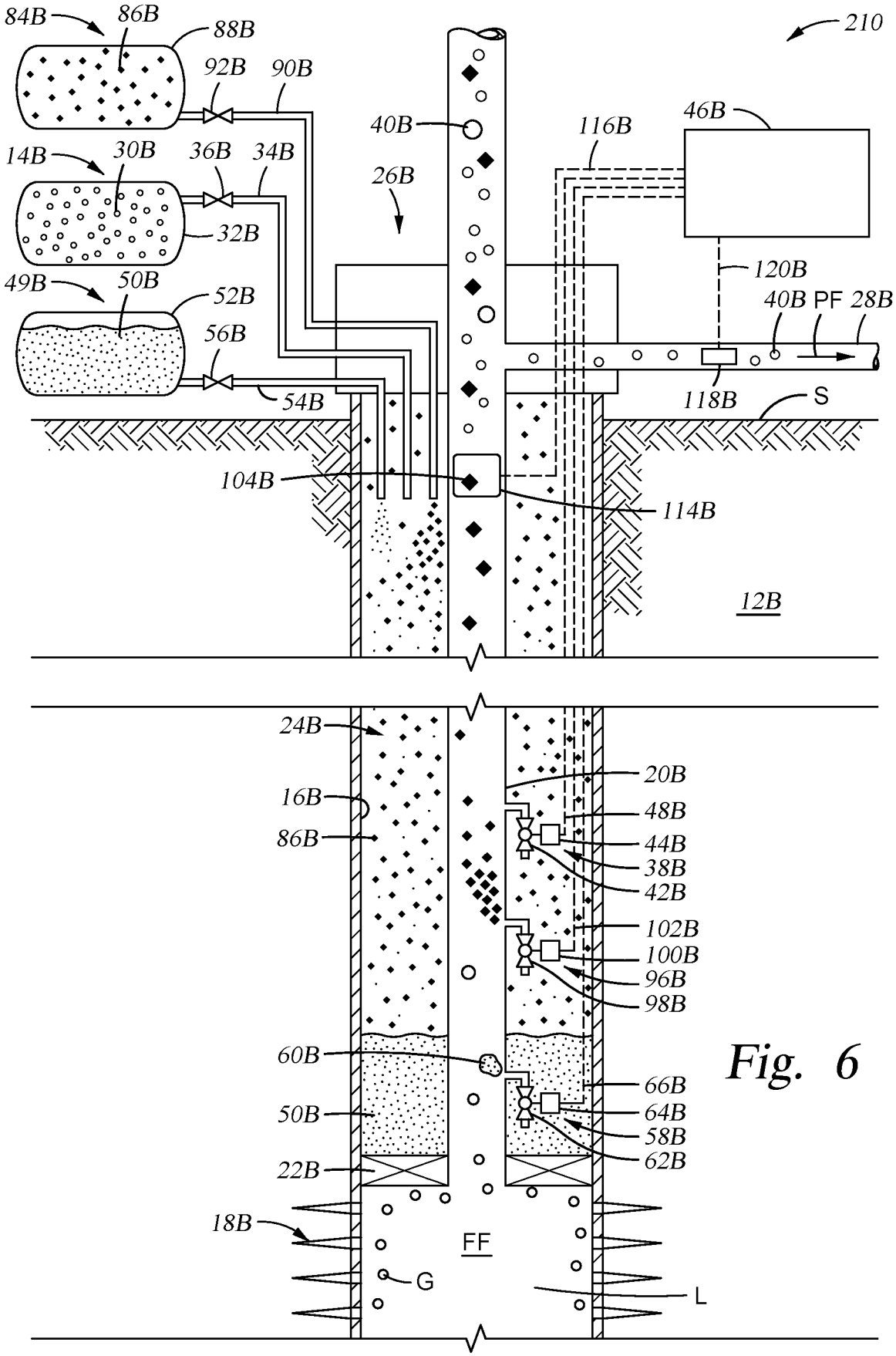
FIG. 6 is a side sectional view of an example of injecting a tracer liquid and a tracer gas into a well assisted by lift gas injection.

Shown in a side partial sectional view in FIG. 6 is another embodiment of a well system 10B, and which includes both a tracer liquid injection system 49B and a tracer gas injection system 84B. In the example of FIG. 6, annulus 24B is filled with the tracer gas 86B and the lift gas bubbles 40B are illustrated as being downstream of bubbles 104B of the tracer gas 86B inside production tubing 20B. With the inclusion of both the tracer liquid and tracer gas injection systems 49B, 84B, injection modules for lift gas, tracer liquid, and tracer gas (38B, 58B, 96B) are mounted onto the outer side walls of production tubing 20B. Similar to the embodiments of FIGS. 1 and 2, the tracer liquid injection module 58B is submerged within the tracer liquid 30B that has collected within a lower end of annulus 24B. Further illustrated are the simultaneous introduction of a tracer liquid assemblage 60B and a tracer gas bubble 104B into the stream of produced fluid PF flowing within the production string 20B. Further in this example, is a tracer sensor 114B within production tubing 20B that selectively senses the presence of one or both the bubble 104B of tracer gas 86B and the tracer liquid assemblage 60B. Alternatively, tracer sensor 114B is on surface. Communication link 116B provides communication of output from sensor 114B to controller 46B. In one non-limiting example of operation, the lift gas 30B within annulus 24B is replaced with the tracer gas 86B, and tracer liquid 30B introduced into the annulus 24B collects at the lower end of annulus 24B and on packer 22B. Modules 58B, 96B are actuated to selectively introduce the tracer liquid assemblage 60B and tracer gas bubbles 104B into the stream of produced fluid PF. In an alternate example, tracer gas bubbles 104B include lift gas 30B and tracer gas 86B. The time required to travel the distances L, Li between the points of injection and the sensor 114B are recorded and a velocities for each of the tracer gas 86B and tracer liquid 50B are estimated in a manner as described above. Based upon these respective velocities, a slip factor for gas and liquid within the produced fluid PF is estimated.

Figure 7:
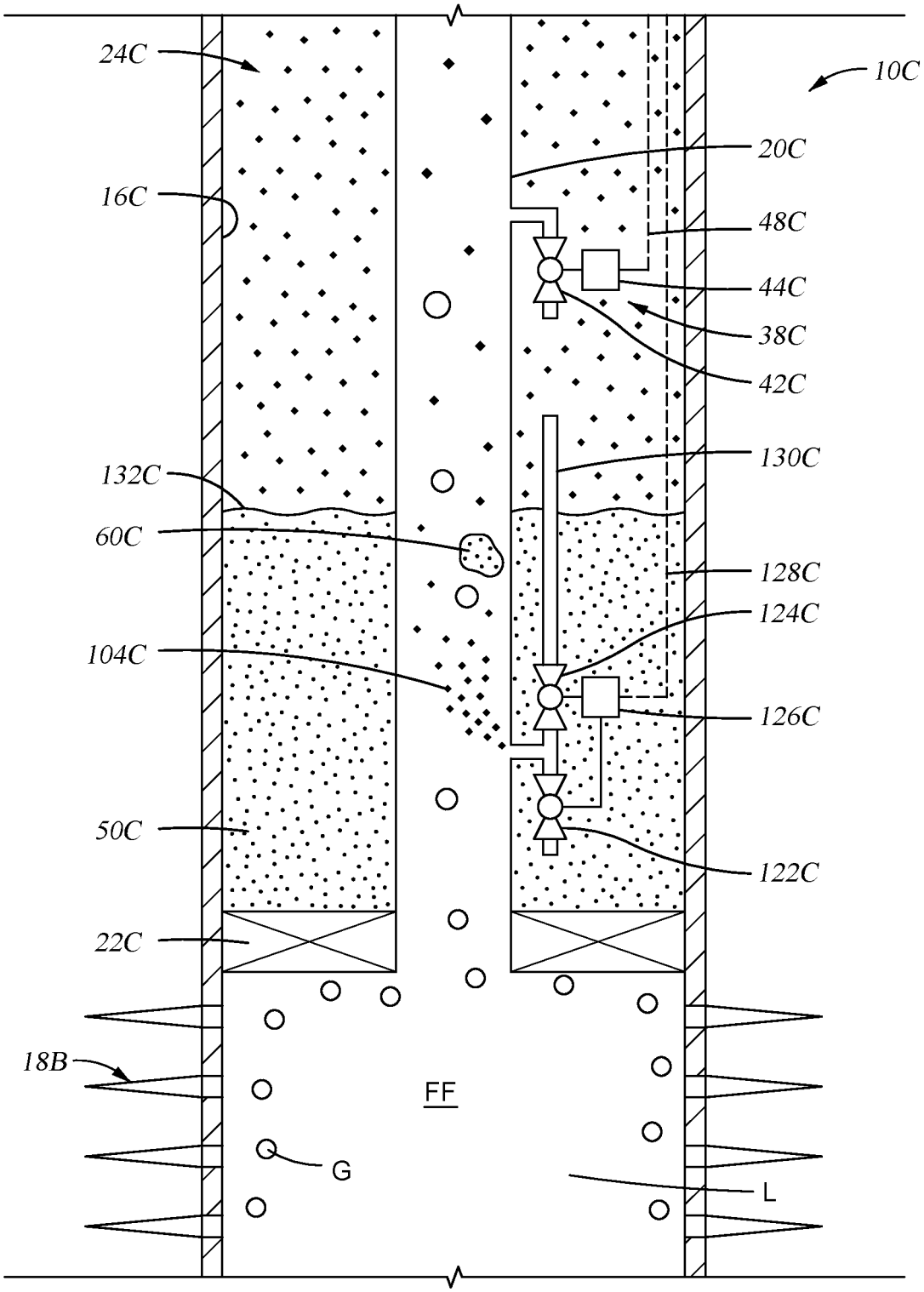
FIG. 7 is a side sectional view of an enlarged portion of the well of FIG. 6, and having an alternate example of a module for injecting tracer liquid and tracer gas.

Referring now to FIG. 7, shown in a side sectional view is a portion of an alternate embodiment of well system 10C. In this example, tracer liquid 50C and tracer gas 86C are introduced into production tubing 22C through a single tracer injection module 120. Included with module 120C is an alternate embodiment of the tracer liquid injection valve 122C shown with an inlet submerged within the tracer liquid 50C, which when opened provides communication between tracer liquid 50C in annulus 24C and inside of production tubing 20C. An alternate embodiment of the tracer gas injection valve 124C is also included with module 120C, and is selectively opened to allow communication of the tracer gas 86C within annulus 24C into production tubing 22C. A passage for the flow of tracer liquid 50C through module 120C flows through valve 122C; and similarly a passage for the flow of tracer gas 86C extends through valve 124C. In the example illustrated, a common actuator 126C provides the motive force for orienting either of valves 122C, 124C into the open or closed configuration and to allow the introduction of the tracer liquid 50C or tracer gas 86C into production tubing 22C. A communication line 128C, in one alternative, provides communication from controller 46C to energize the actuator 126C. Further shown is a snorkel 130C connected to an end of valve 124C, in the example shown snorkel 130C is a tubular member that has an end opposite its connection to valve 124C disposed in a portion of annulus 24C above an interface 132C is between the tracer gas 86C and tracer liquid 50C. Strategic dimensioning of the snorkel 130C allows for injection of tracer gas 86C and tracer liquid 50C into the production tubing 22C at substantially the same location along an axis Ax of the tubing 22C. An advantage of implementing the integrated injection module 120C is the reduction of parts and also the introduction of the tracer fluids at a single location on the production tubing 22C.

In a non-limiting example of operation, a flow regime of the produced fluid PF flowing within the production fluid 20B is identified based on the estimated slip factor value. Alternatively, identification of the flow regime of the produced fluid PF is also based on flow rates of the liquid and gas estimated above. Further optionally, operation of the well system 10 is adjusted to alter the stream of produced flow PF from a particular flow regime to another flow regime. Examples of flow regimes include slug flow, churn flow, wavy flow, bubble flow, annular flow, and combinations. Examples of adjusting well system 10 operation include changing flow rate of lift gas 30 injection, changing flow rate of tracer gas 86 injection, controlling a flow rate of the production fluid PF flowing in the production line, and adjusting a pressure inside the production string 20. In an alternative embodiment, well system 10, 10A-C (FIGS. 1-7) includes more than one lift gas module 38, 38A, 38B and/or more than one tracer gas injection module 96A, 96B, and which are disposed at different depths along the production tubing 20, 20A, 20B, 20C. Providing modules 38, 38A, 38B, 96A, 96B at different depths provides the option of changing the depth(s) at which lift gas 30 and/or tracer gas 86 is introduced into the production tubing 20, 20A, 20B, 20C, in one alternative flow regime(s) inside the production tubing 20, 20A, 20B, 20C are adjusted by selectively introducing lift gas 30 and/or tracer gas 86 into the producing tubing 20, 20A, 20B, 20C. In an embodiment, lift gas 30 and/or tracer gas 86 is selectively introduced into the production tubing 20, 20A, 20B, 20C at designated depths to adjust a flow regime of fluid flowing upward inside the production tubing 20, 20A, 20B, 20C at the designated depth. As discussed in more detail below, certain flow regimes are desired while others are not; and identification of a downhole flow regime can be identified and wellbore parameters adjusted to adjust and alter the flow regime of the produced fluid PF and production tubing 20.

Figure 8:
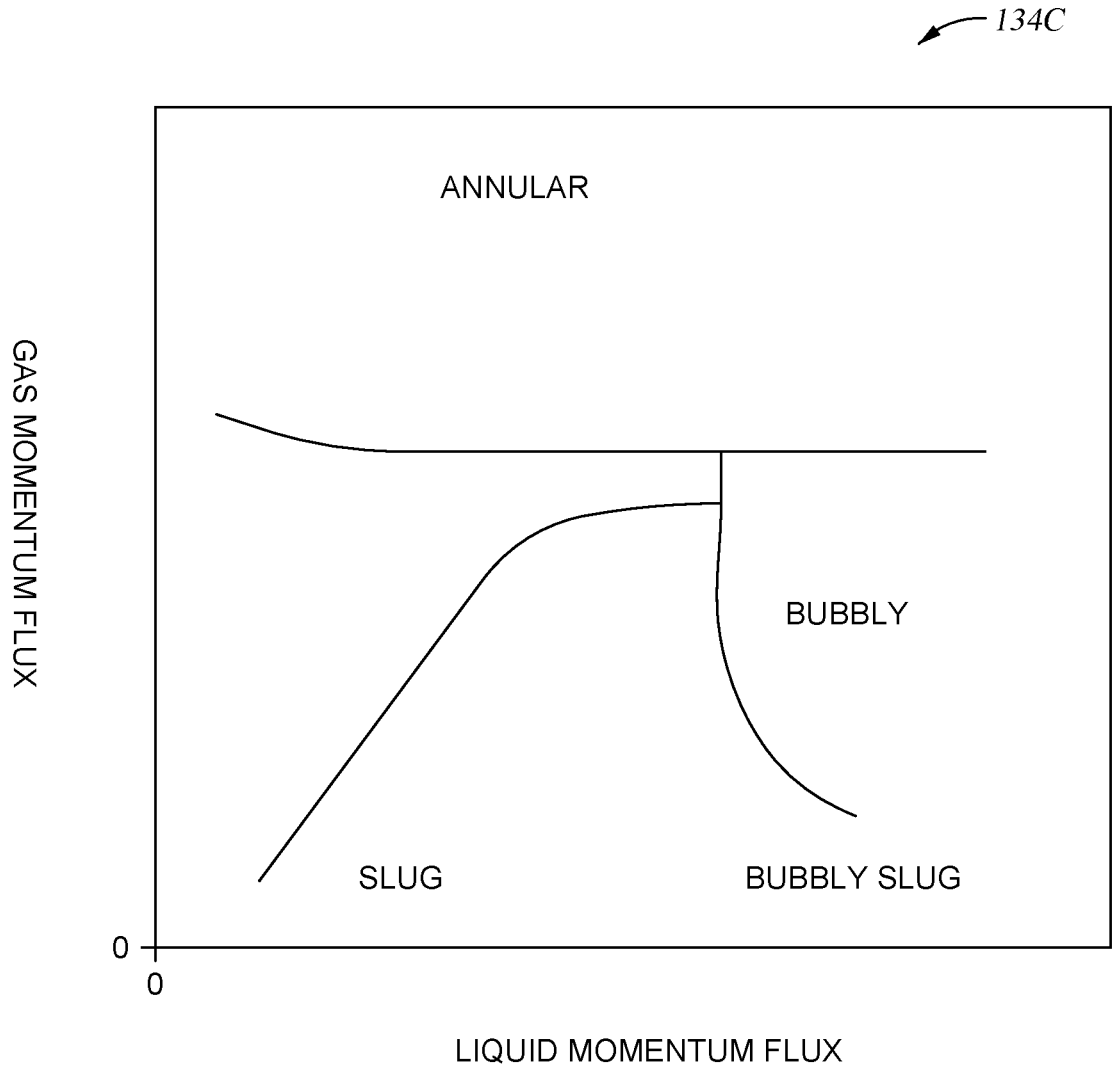
FIG. 8 is a flow regime map of two-phase flow.

A flow regime map 134C is graphically depicted in FIG. 8, based on a vertical flow regime map; which is attributable to Hewitt and Roberts (1969) for flow in a 3.2 cm diameter tube and found at https://authors.library.caltech.edu/25021/1/chap7.pdf. Map 134C provides an exemplary illustration that with changing momentum flux of liquid or gas within a two-phase mixture, the regime of a two-phase flow is altered. For example, illustrated in the map 134C is by increasing an amount gas in a two-phase flow that is presently operating in a region of the map 134C identifying a flow regime that is slug or bubbly gas slug, the flow regime of the two-phase flow is adjusted into an annular flow. One non-limiting step of operation of the method described herein calculating a slip factor based on monitoring a velocity of a trace liquid, a trace gas or both, identifying a flow regime of the produced fluid PF in the production tubing 20 (FIG. 1), and adjusting a parameter of well operation to alter a flow regime of the two-phase flow of the produced fluid PF to a different flow regime.

Figure 9:
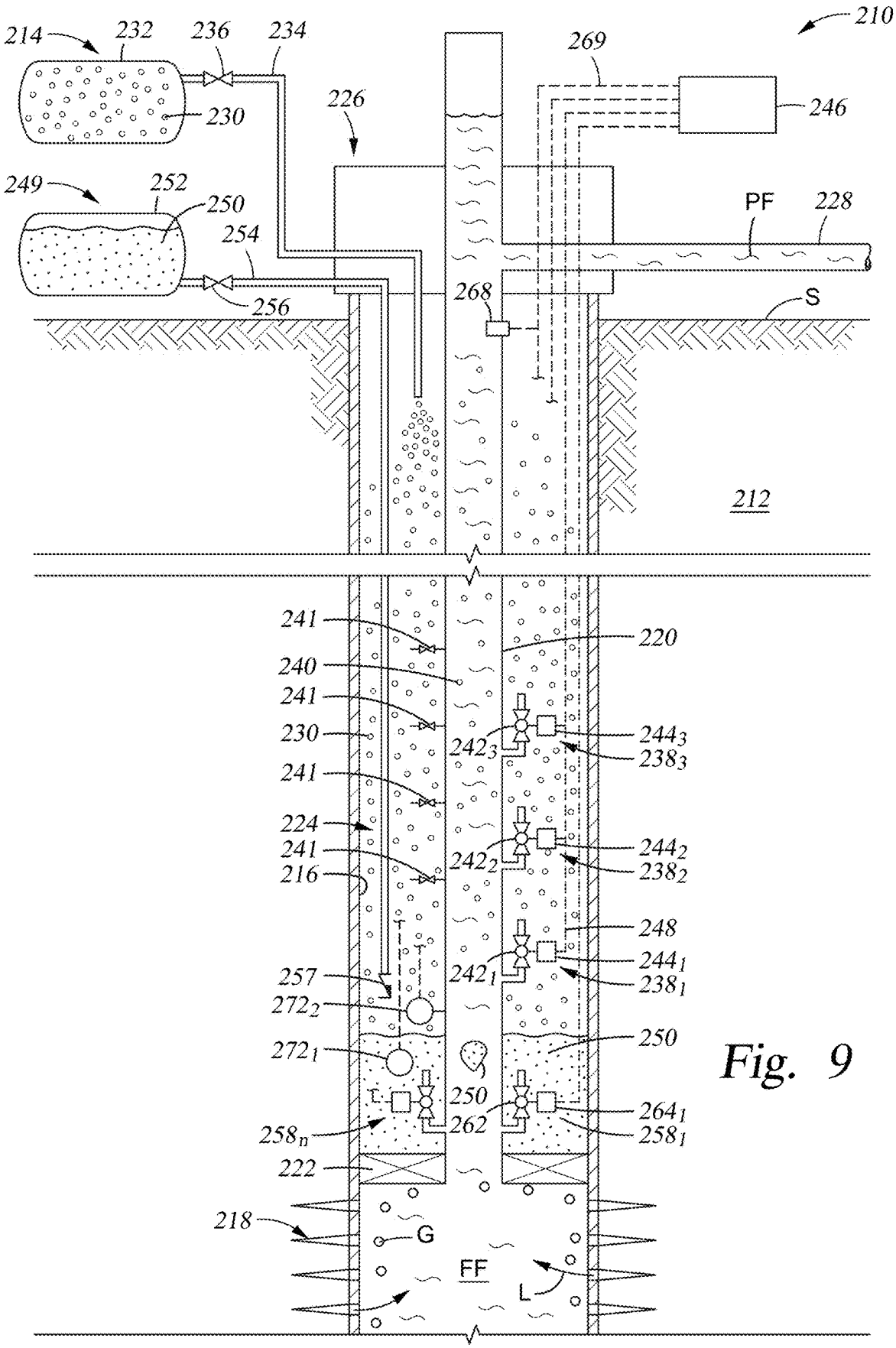
FIGS. 9 and 10 are side sectional views of examples of injecting a chemical additive into a well assisted by lift gas injection.
Figure 10:
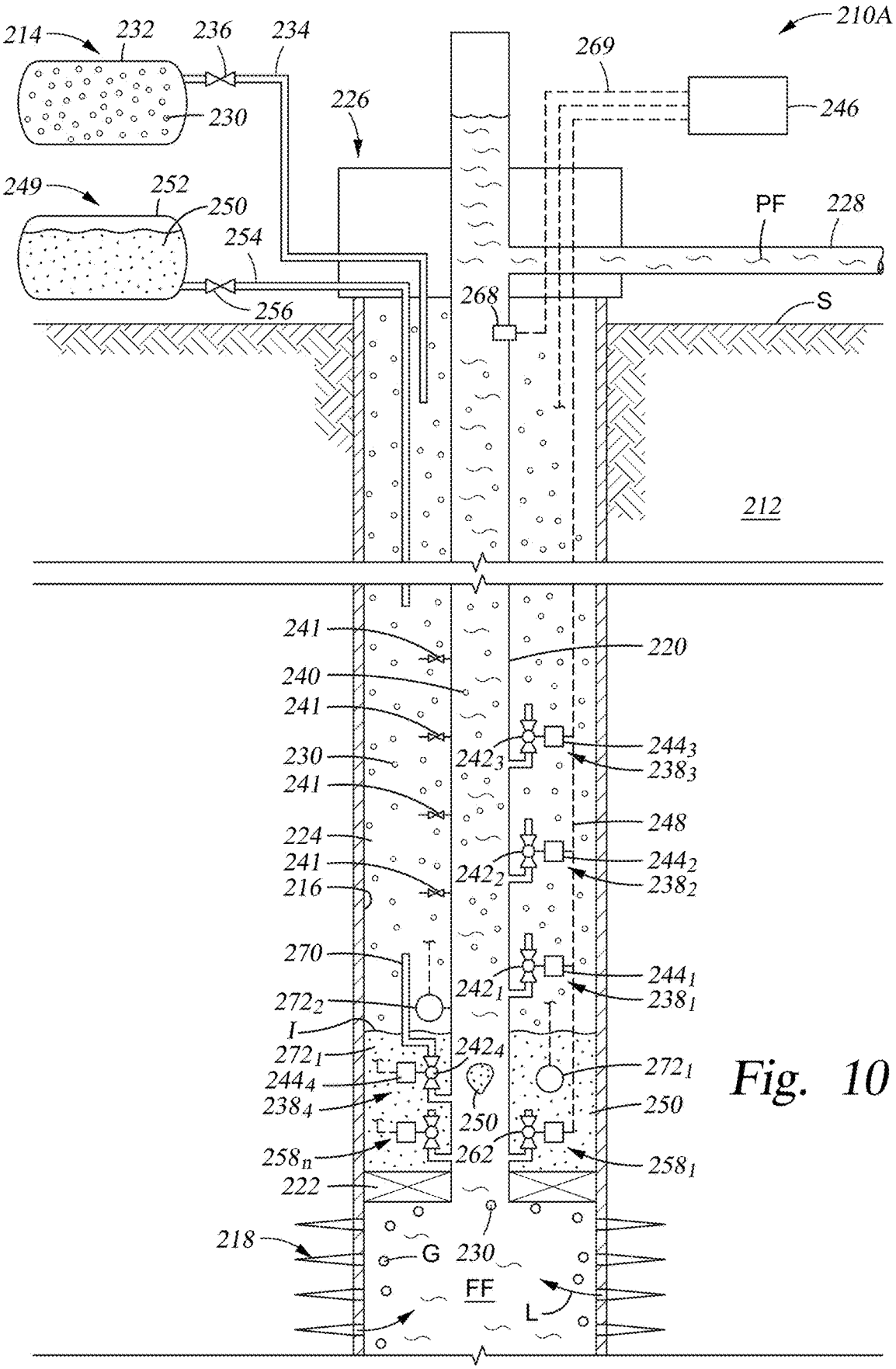

Embodiments of a lift gas system are shown in FIGS. 9 and 10 that provide injection of a chemical additive without the need for a conventional capillary, and in which the control of the chemical injection is moved downhole at or proximate to the injection point. In FIG. 9 shown in a side partial sectional view is an alternate example of a well system 210 for producing hydrocarbons from within a subterranean formation 212 that includes a lift gas system 214 for assisting with the lift of liquids collected within a wellbore 216 that penetrates formation 212. Perforations 218 are shown that provide a pathway for the hydrocarbons and other fluids to enter into the lower end of wellbore 216. As shown, the hydrocarbons and other fluids in the formation 212 are referred to herein and illustrated in FIG. 9 as formation fluid FF, and that includes liquid L with amounts of gas G dispersed within the liquid L. A string of production tubing 220 is shown inserted within wellbore 216, inside of which the formation fluid FF make its way uphole. A packer 222 is set at lower end of production tubing 220 and forms a barrier to a flow of formation fluid FF into an annulus 224 between the production string 220 and sidewalls of wellbore 216. A wellhead assembly 226 is set at an opening of wellbore 216 and on surface S. Wellhead assembly 226 provides pressure control for the well 216, and distributes produced fluid PF that has exited well 216. A production line 228 is shown having an end attached to wellhead assembly 226, and which is in communication with the production tubing 220. Within the wellhead assembly 226 of FIG. 9, produced fluid PF flowing in the production tubing 226 is redirected into the production line 228; which carries the produced fluid PF offsite.

In the example of FIG. 9, the lift gas system 214 is shown injecting lift gas 230 into the well 216. A lift gas source 232 is schematically shown as a container on surface S, and which provides the lift gas 230. Alternatives of the lift gas source 232 include surrounding wells, pipelines, compressors, tanks, and the like. A lift gas line 234 is shown having an inlet end attached to the lift gas source 232 and a distal discharge end inserted into the well in annulus 224. In a non-limiting example, lift gas 230 is introduced into annulus 224 by selectively opening and closing a lift gas valve 236 illustrated disposed within lift gas line 234. As shown in the example of FIG. 9, an amount of lift gas 232 having been introduced into the well 216 and that substantially occupies annulus 224. Lift gas injection modules $\mathbf{238}_{1\text{-}3}$ are shown mounted onto an outer sidewall of production tubing 220 that selectively inject amounts of the lift gas 230 into the production tubing 220 to produce bubbles 240 of lift gas 230 inside the production tubing 220 that are combined with the formation fluid FF to form the produced fluid PF. Optional pressure actuated valves 241 are also shown mounted to an outer surface of production tubing 220 that in response to magnitudes of pressure in the annulus 224 or tubing 220 selectively open or close to inject or block a flow of lift gas 230 into the tubing 220. In examples the lift gas injection modules $\mathbf{238}_{1\text{-}3}$ include an injection valves $\mathbf{242}_{1\text{-}3}$ that selectively open to inject lift gas 230 into production tubing 220. Further examples include actuators $\mathbf{244}_{1\text{-}3}$ coupled with and for actuating each injection valve $\mathbf{242}_{1\text{-}3}$. An example of a controller 246 is shown outside of wellbore 216 that optionally provides control signals to the modules $\mathbf{238}_{1\text{-}3}$ via a communication line 248. Examples of line 248 include fiber optic, tubing encased conductor ("TEC"), conductive elements, hydraulic lines, and other currently known or later developed means of transmitting signals. In examples the produced fluid PF with its added bubbles 240 is a two-phase flow stream with a density less than the formation fluid FF and which promotes the flow of the produced fluid PF upwards within the well 216 and lifting of the formation fluid FF.

Still referring to FIG. 9, an example of a chemical additive injection system 249 is included with the well system 210 and which is used for selectively providing chemical additive 250 into the stream of produced fluid PF flowing upwards within the production tubing 220. Non-limiting examples of use include injecting a chemical additive 250 into the well system 210 to correct or otherwise address an anomaly that has occurred or is occurring in the production tubing 220 or other places in the wellbore 216. Example anomalies include the produced fluid PF in the production tubing 220 having undesirable substances, properties, or flow regimes and the production tubing 220 having undesirable deposits: where the undesirable substances include one or more of foam, biological compounds, hydrates, corrosive compounds, scale, emulsions, asphaltene, and combinations; the undesirable properties include a viscosity, density, surface tension, specific weight, specific gravity, and specific volume; and examples of undesirable flow regimes include slug, churn, bubbly, and bubbly slug. Examples of the chemical additive 250 include foaming agents (to maintain gas bubble size), anti-foaming agents, biocides, corrosion inhibitors, scale inhibitors, asphaltene inhibitors, agents to prevent hydrate formation, adsorbents, emulsifiers, emulsion breakers, viscosity reducers, any currently known or later developed agent injected into a well, and combinations thereof. In this example, chemical additive 250 is provided by a chemical additive source 252 which is schematically illustrated as a vessel, alternate embodiments of the chemical additive source 252 include pipelines, tanks, trucks, and the like. A chemical additive supply line 254 extends from chemical additive source 252 and has a discharge end set within annulus 224. Optionally included in chemical additive supply line 254 is a chemical additive supply valve 256 that is selectively opened and closed to allow for the discharge of the chemical additive from the chemical additive supply source 252 and into annulus 224. In the example shown the chemical additive 250 has a density higher than the lift gas 230, and when added into the annulus 224 the chemical additive 250 drops through the lift gas 230 and collects on packer 222 in a lower end of annulus 224. In alternatives when fluid(s), such as one or more of brine, completion fluid, etc. is/are present on packer 222 prior to chemical additive 250 addition, chemical additive 250 will stratify above fluid(s) of higher density. Chemical additive injection modules $\mathbf{258}_{1\text{-}n}$ are shown included with the example chemical additive injection system 249 and disposed in the annulus 224 at a depth between packer 222 and lift gas injection module 238, optionally a single one of the modules $\mathbf{258}_{1\text{-}n}$ is included with system 249. As shown, a lower end of line 254 is disposed deep in the well 216 and proximate injection modules $\mathbf{258}_{1\text{-}n}$, in alternatives line 254 terminates farther uphole or connects to a port (not shown) in wellhead 226. In an embodiment line 254 is a capillary that is optionally open on its bottom end to allow chemical additive 250 to flow freely from inside line 254 into annulus 224. Strategically placing line 254 with its open end proximate packer 222 avoids inadvertently dispensing chemical additive 250 onto sidewalls of wellbore 216, which hinders delivery of additive 250 to chemical additive injection modules $\mathbf{258}_{1\text{-}n}$ and into tubing 220. In alternatives, a check valve 257 is provided on a bottom end of line 254 to block fluid in the well 216 from entering line 254. A non-limiting example of a capillary is an elongate tubular flow line having an inner diameter ranging from about 0.025 inches to about 0.5 inches, and that alternatively ranges to and upwards of about 1.0 inches, depending on the application of use. Embodiments of this example include a capillary with sidewalls that are substantially continuous and without connections similar to other wellbore tubulars, such as joints or collars in a string of pipe and in an alternative is an elongate single extrusion.

In a non-limiting example, chemical additive 250 is added to annulus 224 and due to gravity drops onto and collects on an upper surface of packer 222. An amount of chemical additive 250 is added so that its upper level is above chemical additive injection modules $\mathbf{258}_{1\text{-}n}$ to fully submerge chemical additive injection modules $\mathbf{258}_{1\text{-}n}$ within the chemical additive 250. In this example operation of chemical additive injection modules $\mathbf{258}_{1\text{-}n}$ is similar to that of the lift gas injection module 238, and each include a chemical additive injection valve 262 shown coupled with a chemical additive actuator 264 for opening and closing valve 262. In the illustrated embodiment, communication line 248 connects also to or is otherwise in communication with actuator 264 to provide for communication between modules $\mathbf{258}_{1\text{-}n}$ and surface S. Connecting chemical additive injection modules $\mathbf{258}_{1\text{-}n}$ and lift gas injection modules $\mathbf{238}_{1\text{-}3}$ to communication line 248 allows for sharing the same TEC and control of modules $\mathbf{238}_{1\text{-}3}$, $\mathbf{258}_{1\text{-}n}$ in a multi-drop manner. In a non-limiting example, signals for opening and closing the valve 262 are sent to actuator 264 via communication line 248. In an alternative, modules $\mathbf{258}_{1\text{-}n}$ and lift gas injection modules $\mathbf{238}_{1\text{-}3}$ are in communication with surface S via separate communication lines (not shown) and where a TEC makes up one or more of the communication lines.

An optional chemical additive sensor 268 is shown coupled with production tubing 220 and at a location distal from where the chemical additive 250 is introduced into the production tubing 220. In alternate embodiments the sensor 268 is proximate to the modules $258_{1-n}$ or within wellhead assembly 226. In this example, sensor 268 is in communication with controller 246 via a communication link 269, an embodiment of which is like the other communication lines disclosed herein is hard-wired, fiber optic, and/or wireless. Sensor 268 optionally connects to line 248 for communication with controller 246 and/or surface S. In an example, a signal or signals from controller 246 to one or more of modules $258_{1-n}$ via communication line 248 commands module(s) $258_{1-n}$ to open so that chemical additive 250 is injected from the bottom of annulus 224, through chemical additive injection module(s) $258_{1-n}$, and into the production tubing 220. In alternatives the signal(s) is generated and communicated to one or more of modules $258_{1-n}$ in response to occurrence of one or more of the anomalies discussed above; or in anticipation of an anomaly occurrence. In alternatives, an occurrence or anticipation of an occurrence (such as by recognition of a condition or conditions in the wellbore 216 under which such anomalies can or are likely to occur) are identifiable from conditions in the wellbore 216 selectively monitored by sensors (not shown) in communication with the controller 246 or other devices on surface S. An example of anticipating an anomaly includes comparing real time pressure and temperature in the wellbore 216 (or within tubing 220) to conditions of pressure and temperature at which an anomaly (e.g., precipitation) is expected to occur, and injecting chemical additive 250 to address any precipitation. Further included in this example is controlling a rate and/or timing of chemical additive 250 being injected into the production tubing 220 so that a designated amount (e.g., flowrate, total mass, or total volume) of injection of chemical additive 250 is achieved. Examples of controlling flowrate of chemical additive 250 include metering a percent open of injection valve 262 to a particular orifice size, or injecting through a particular quantity of the modules $258_{1-n}$. Optionally, the determination of the timing of injection and/or flowrate of chemical additive 250 is performed by the controller 246, operations personnel, another processing device, or combinations. It is within the capabilities of those skilled in the art to determine a designated amount of chemical additive 250 for injection. In a non-limiting example, well system 210 is operated as a closed loop control system in which timing and or flowrate of chemical additive 250 injection is based on one or more of flowrate of fluid flowing in production tubing 220, flow regime of fluid flowing in production tubing 220, pressure and/or of fluid flowing in production tubing 220, other monitored conditions, and combinations.

Referring now to FIG. 10, shown in a side partial sectional view is an alternate example of well system 210A having a lift gas injection module $238_4$ that includes an injection valve $242_4$ and actuator 2444 for selectively injecting lift gas 230 into production tubing 220. Injection module $238_4$ is shown below interface I between chemical additive 250 and lift gas 230. An annular snorkel 270 is included with injection module $238_4$ for communicating injection gas 230 to injection module $238_4$. In the example shown, an inlet on an upper end of snorkel 270 is disposed above interface I, and a lower end of snorkel 270 connects to an inlet of injection valve $242_4$. In this example, injection gas 230 is injected into tubing 220 below the chemical additive 250.

An advantage of the method and system for injecting chemical additives in a well is that a conventional capillary is not required in the well, and injecting through a surface controlled downhole valve moves control of the chemical additive injection downhole to the injection point. Whenever it is desired to inject chemical, the valve can be opened and closed on demand—that in examples produces a desirable result of ensuring a designated amount of chemical additive 250 is injected into the tubing 220 and at a designated time. Injecting directly into fluid (PF and/or FF) eliminates the unpredictability of how much of the additive reaches the fluid, which is in contrast to currently known methods in which some amount of injection lands onto sidewalls of the tubing 220 and may not fully come into contact with fluid in tubing 220. Furthermore, the valve 262 can be used to meter chemical additive by varying a restriction, by only injecting during a discrete amount of time, or by injecting over a duty cycle. In the well systems 210, 210A disclosed above and illustrated in FIGS. 9 and 10, fluid liquid level is calculated based on pressure in the annulus 224, downhole conditions (such as those sensed by surface-controlled valves $242_{1-4}$), density of gas G and/or liquid L, and depths of valves $242_{1-4}$. In alternatives, flow regime of fluid flowing in tubing 220 is adjusted by selectively injecting chemical additive 250 into tubing 220. In one example of adjusting a flow regime, chemical additive 250 includes a foaming agent and that is injected into the tubing 220 with the injection system 249 to alter slug flow into a steady flow regime. In this example, evidence of slug flow of fluid in production tubing 220 is identified based on conditions in fluid (FF or PF) flowing in tubing 220 and sensed by one or more of modules $238_{1-4}$, $258_{1-n}$ or optional pressure sensors $272_{1,2}$. Further advantages of well systems 210, 210A include real time injection of chemical additive 250 and/or real time adjustment of a rate of injection of chemical additive 250. In alternatives, a rate of chemical additive 250 is set so that a ratio of chemical additive 250 to fluid (FF or PF) in the tubing 220 is maintained at a designated amount; examples of a designated amount is that which is estimated to inhibit formation on sidewalls of tubing 220 of corrosion, scale, hydrates, asphaltene, other deposits deemed undesirable, or combinations. In a non-limiting example, a flowrate of injection of chemical additive 250 (mass or volume over time) is estimated based on a port diameter of injection valve 262 (or total port diameters when chemical additive is injected through multiple valves) and a pressure differential across valve 262 (or valves). Estimating a flowrate of chemical injection 250 (or an adjustment in flowrate) is within the capabilities of one skilled in the art.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method for producing fluid from a wellbore comprising:

flowing a produced fluid upwards within production tubing that is disposed in the wellbore;

disposing an amount of chemical additive into an annulus that surrounds the production tubing;

collecting the chemical additive in the annulus;

selectively injecting lift gas into the production tubing at a depth below an upper level of the chemical additive collected in the annulus; and changing a flow regime of the produced fluid by selectively injecting the chemical additive from the annulus and into the production tubing at a depth below an upper level of the chemical additive collected in the annulus.

2. The method of claim 1, wherein the step of injecting is through a chemical injection module that is mounted onto the production tubing.

3. The method of claim 2, further comprising selectively controlling a flowrate of chemical additive being injected into the production tubing by injecting the chemical additive through a particular quantity of chemical injection modules.

4. The method of claim 3, wherein a controller in communication with sensors in the wellbore is configured to selectively control a flowrate of chemical additive being injected into the production tubing.

5. The method of claim 1, wherein the chemical additive is disposed into the annulus through a chemical additive supply line having a discharge end deep in the annulus and proximate where the chemical additive is being injected into the production tubing.

6. The method of claim 1, wherein the flow regime is a slug flow, and the chemical additive comprises a foaming agent that alters the slug flow inside the production tubing into a steady flow regime.

7. The method of claim 6, wherein the slug flow is identified based on conditions inside the production tubing that are sensed by sensors.

8. The method of claim 1, wherein the chemical additive further removes scale or corrosion inside the production tubing.

9. The method of claim 1, wherein the chemical additive mitigates an anomaly inside the production tubing that is selected from the group consisting of scale in the tubing, corrosion in the tubing, foam in the tubing, and combinations thereof.

10. The method of claim 1, wherein the chemical additive is introduced into the annulus through an opening on a lower end of a capillary that is disposed in the well, and wherein the opening is selectively blocked by a check valve attached to a lowermost end of the capillary and disposed adjacent a packer at a bottom of the annulus.

11. The method of claim 1, further comprising injecting lift gas into the production tubing through a lift gas injection module mounted to the production tubing.

12. The method of claim 11, wherein the lift gas is routed to the lift gas injection module through a snorkel having an end in communication with lift gas in the annulus.

13. The method of claim 1, wherein an amount of chemical injection is controlled by adjusting an orifice size.

14. A method for producing fluid from a wellbore comprising:

flowing a produced fluid upwards within production tubing that is disposed in the wellbore;

disposing an amount of chemical additive into an annulus that surrounds the production tubing;

collecting the chemical additive in the annulus;

monitoring pressure and temperature in the wellbore in real time:

comparing the real time pressure and temperature to pressure and temperature at which an anomaly is expected to occur;

identifying that the anomaly is likely to occur based on the step of comparing; and injecting the chemical additive from the annulus and into the production tubing based on the step of identifying.

15. The method of claim 14, further comprising monitoring fluid flow rate or flow regime in real time and comparing the real time fluid flow rate or flow regime to fluid flow rate or flow regime at which an anomaly is expected to occur.

16. The method of claim 14, wherein the anomaly comprises precipitation in the production tubing.

17. The method of claim 14, wherein the real time pressure and temperature is monitored in the annulus, or within tubing, or both.

18. The method of claim 14, wherein the chemical additive is being injected in real time into the production tubing through a surface controlled chemical injection module in the annulus that is submerged in the chemical additive.

19. The method of claim 18, further comprising controlling a flowrate of the chemical additive being injected in real time by adjusting an orifice size in a valve in the chemical injection module or by injecting the chemical additive through a particular quantity of chemical injection modules.

* * * * *